United States Patent [19]

Worley et al.

[11] Patent Number: 4,520,609

[45] Date of Patent: Jun. 4, 1985

[54] GRID TEE FOR SUSPENSION CEILINGS OR THE LIKE

[75] Inventors: Robert F. Worley, Bay Village; Jeffrey L. Petras, Avon Lake, both of Ohio

[73] Assignee: Donn Incorporated, Westlake, Ohio

[21] Appl. No.: 424,026

[22] Filed: Sep. 27, 1982

[51] Int. Cl.[3] ..... E04B 5/52

[52] U.S. Cl. ..... 52/729; 52/484

[58] Field of Search ..... 52/729, 484, 720

[56] References Cited

U.S. PATENT DOCUMENTS

| | | | |
|---|---|---|---|
| 991,603 | 5/1911 | Brooks | 52/729 |
| 3,193,063 | 7/1965 | Brown et al. . | |
| 3,207,057 | 9/1965 | Brown et al. . | |
| 3,221,466 | 12/1965 | Downing, Jr. et al. | 52/729 |
| 3,221,846 | 12/1965 | Brown et al. . | |
| 3,369,332 | 2/1968 | Harlan | 52/720 |
| 3,501,185 | 3/1970 | Brown et al. . | |
| 3,778,947 | 12/1973 | Sauer | 52/484 |
| 3,845,594 | 11/1974 | Butts et al. | 52/729 |
| 4,019,300 | 4/1977 | Sauer et al. | 52/484 |
| 4,206,578 | 6/1980 | Mieyal | 52/484 |

FOREIGN PATENT DOCUMENTS

| | | | |
|---|---|---|---|
| 2634576 | 2/1978 | Fed. Rep. of Germany | 52/729 |
| 1068482 | 6/1954 | France | 52/729 |
| 827723 | 5/1981 | U.S.S.R. | 52/729 |

OTHER PUBLICATIONS

"Heavy Duty Main Tee"; 3-6-64, Donn Products, Inc., Westlake, Ohio.

*Primary Examiner*—Donald G. Kelly
*Assistant Examiner*—Michael Safavi
*Attorney, Agent, or Firm*—Pearne, Gordon, Sessions, McCoy, Granger & Tilberry

[57] ABSTRACT

Grid tees for suspension ceilings are disclosed in which a cross section is provided concentrating material at the two extremities of the grid tees. Such grid tee sections are also formed to provide a shear center which is centrally located substantially along the web section of the tee. In some embodiments, a single strip is formed to provide three laterally extending layers adjacent to the upper extremity of the bulb, and in another embodiment a single strip of material is formed to concentrate material on one side of the web at the bulb extremity and on the other side of the web at the flange extremity so as to balance the section and locate the shear center along the web plane.

3 Claims, 6 Drawing Figures

GRID TEE FOR SUSPENSION CEILINGS OR THE LIKE

BACKGROUND OF THE INVENTION

This invention relates generally to grid tees for suspension ceilings or the like, and more particularly to a novel and improved grid tee which provides improved material efficiency and reduces the material requirements to provide a given strength and rigidity.

Prior Art

Various forms of grid tees for suspension ceilings are known. Generally, such tees are produced by bending one or more strips to relatively thin metal to produce the required shape. Such tees usually provide a central web having a bulb along its upper edge and oppositely extending flanges along its lower edge. Examples of such tees are illustrated and described in U.S. Pat. Nos. 3,193,063; 3,207,057; 3,221,846; and 3,501,185.

In suspension ceilings, the grid tees are interconnected in a grid to define panel receiving openings in which panels are positioned and supported. In addition, various types of lighting fixtures and other accessories are often supported on the grid. Such other accessories, for example, include air boots, return air vents, air diffusers, and special purpose devices and supports.

Industry standards require sufficient rigidity so that the grid tees will not sag more than the predetermined small amount under load, and so that the assembly will support specified loads without failure such as roll failure. Still further, the grid tees for a given use often have to meet specified dimensional and envelope requirements.

Various grid tee designs have been established to meet these and other requirements in an efficient and economical manner. U.S. Pat. No. 4,206,578, assigned to the assignee of the present invention, discloses a symmetrical grid tee which makes efficient use of the material from which it is manufactured, so that greater strength and rigidity are achieved from a given amount of material.

In the grid tee illustrated in such patent, three separate strips of metal are formed into a tee, so that a relatively thin, double web is provided and material is concentrated at the extremities where it is most effective at producing strength and rigidity. Such illustrated tee, however, provides three separate strips which must be handled and formed. Such patent is incorporated herein by reference.

SUMMARY OF THE INVENTION

In accordance with the present invention, a novel and improved grid tee structure is provided which makes efficient use of the material of the tee and which can be easily and economically produced.

In accordance with one important aspect of this invention, a single strip of material is formed to provide a novel and improved bulb having multiple layers of material at the bulb extremity of the tee to concentrate material at such extremity of the tee. Such additional material located at the bulb extremity of the tee efficiently contributes to the strength and rigidity of the tee.

In accordance with another aspect of this invention, a non-symmetrical, single layer web grid tee is structured to provide a shear center which is located substantially at the plane of the web, so that the tee does not tend to encounter roll failure and so that substantial strength and rigidity are provided without requiring excessive material. Since the web does not contribute materially to the strength of the grid, grids having a single web tend to be more material efficient with respect to the web portion, and if the grid section is structured for sufficient rigidity and provides a central shear center, a superior grid is provided.

Several illustrated embodiments illustrate these aspects of the invention. Some embodiments are symmetrical with respect to the central web plane of the tee, and others are not.

DETAILED DESCRIPTION OF THE DRAWINGS

In U.S. Pat. No. 4,206,578, a grid tee section is illustrated in which efficient material use is obtained by concentrating material at the extremities of the grid. In the illustrated embodiment of that patent, however, two separate strips of material form the bulb, with material concentrated at the bulb extremity, and a separate cap is provided at the flange extremity of the grid to concentrate material at such extremity. On the other hand, with the present invention, efficient use of the material is accomplished without requiring as many separate strips of material in the fabrication of the grid tee.

Figure 1:
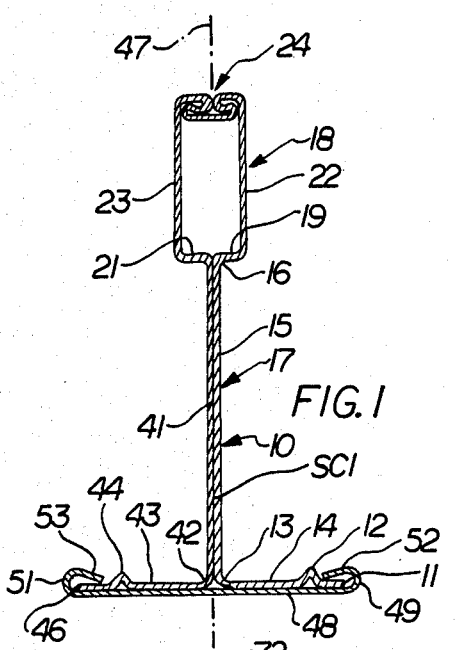
FIG. 1 is a cross section of a grid tee in accordance with one embodiment of this invention in which the tee is symmetrical with respect to a central plane along the web of the tee and in which folds are provided in the bulb material to concentrate material in the bulb extremity of the grid tee.
Figure 1A:
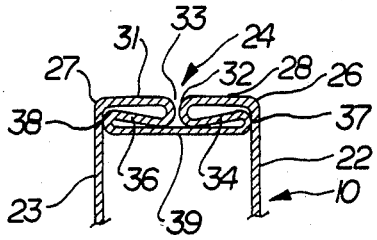
FIG. 1A is an enlarged, fragmentary view of the upper edge of the bulb of the tee illustrated in FIG. 1.

In the embodiment of FIGS. 1 and 1A, the grid tee is formed of two strips of material, and is symmetrical with respect to the central plane along the web thereof.

Such embodiment provides a first strip of metal 10 which extends in from one edge 11 to a raised stiffening rib 12, and therefrom to a right angle bend at 13 to provide one flange portion 14. From the bend, the strip 10 extends out to a second right angle bend at 16, and between the bends 13 and 16, the strip provides one layer 15 of a central web 17.

A bulb 18 is formed from the strip 10 to provide opposed lateral portions 19 and 21, spaced and parallel sidewalls 22 and 23, and an upper portion 24. This upper portion provides three laterally extending layers to concentrate material at the upper extremity of the grid. In the illustrated embodiment, best illustrated in FIG. 1A, the material of the strip 10 is formed with right angle bends 26 and 27, which respectively connect the sidewalls 22 and 23 to lateral portions 28 and 31, which are substantially coplanar and cooperate to provide the outermost of the three layers. At the inner extremities of the portions 28 and 31, reverse bends are provided at 32 and 33 to provide the second layer consisting of the two lateral portions 34 and 36. At the outer extremities of each of the portions 34 and 36, reverse bends 37 and 38 are again provided to join with the inner layer or third lateral portion 39.

Referring again to FIG. 1, the strip 10 is formed to provide the other layer 41 of the central web 17, which extends in face-to-face adjacency with the first layer 15 to a right angle bend at 42. From the bend 42, the strip is formed with a second flange portion 43, which is similar but opposite to the flange portion 14. The flange portion 43 therefore provides a stiffening rib 44 and extends to an edge 46. In this embodiment, the strip 10 is completely symmetrical with respect to a central plane 47, which extends along the abutting faces of the two portions of the central web 17.

The grid tee is completed by a second strip of metal 48 which extends along the lower surface of the flange portions 14 and 43 and is formed with reverse bends at 49 and 51 so that its edges embrace and clamp at 52 and 53 over the outer edges of the flange portions 14 and 43, respectively. Therefore, the shear center is located along the central web 17. The shear center of this grid tee is located at about SC1. The shear center or center of twist for a transverse section of a beam is the point of intersection of the bending axis and the plane of the transverse section. Any transverse force applied through the shear center causes no torsion of the beam. Since the grid tees in a suspension ceiling grid are generally symmetrically loaded with respect to the central web, the shear center should be located in the web plane or as close thereto as possible so the twist or roll failures are minimized.

With this structure, double layers of material are provided at the flange extremity of the grid and triple layers of material are provided at the bulb extremity of the grid. By concentrating the material formed in the grid at the extremities in this manner, increased rigidity and strength are provided for a given amount of material forming the grid. Further, in this embodiment, such multiple layers of material at the bulb extremities are achieved without requiring a separate strip, which would otherwise have to be incorporated into the structure to provide this efficient structure.

Figure 2:
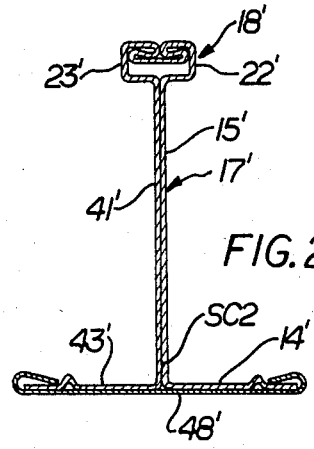
FIG. 2 is a cross section of a second embodiment grid tee which is similar in most respects to the embodiment of FIG. 1, but differs therefrom in that the height of the bulb is reduced.

The embodiment of FIG. 2 is identical to the embodiment of FIG. 1 except for the fact that the height of the bulb is decreased. In this embodiment, similar reference numerals are utilized to refer to similar components of the grid, but a prime (') is added to indicate that reference is being made to the embodiment of FIG. 2. Here, the central web 17' is again formed of two abutting layers 15' and 41'. Similarly, the bulb 18' provides spaced and parallel walls 22' and 23'. However, the length of the two walls 22' and 23' is much less than the length of the corresponding walls 22 and 23 of the embodiment of FIG. 1. In this embodiment, however, three layers are provided at the upper extremity of the bulb in the same manner as illustrated in FIGS. 1 and 1A. The oppositely extending flange portions 14' and 43' are again formed as in the first embodiment, and a separate strip of metal 48' is mounted on these portions to provide a double layer at the flange extremity of the grid.

It can be noted from comparing FIGS. 1 and 2 that this invention can therefore be incorporated in grids wherein the particular portions of the components of the grid are changed with respect to each other, while still achieving the high strength efficiency of the overall structure. Here again, multiple layers are provided at the bulb extremity and at the flange extremity of the grid and a high degree of rigidity is provided with a minimum amount of material. The shear center of this grid tee embodiment is located at about SC2.

Figure 3:
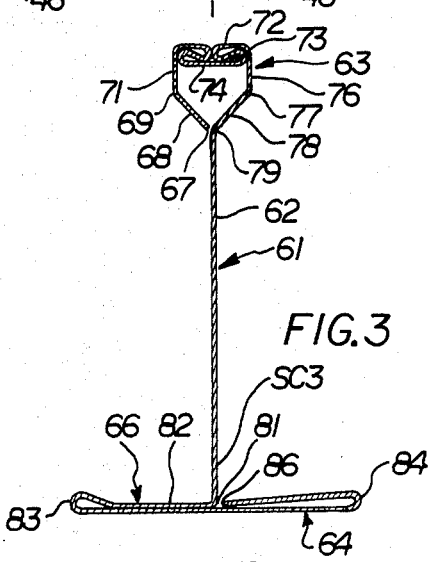
FIG. 3 is a cross section of a grid tee in accordance with another embodiment of this invention, in which the tee is formed of a single strip of metal, provides a single layer web, provides a shear center in the plane of the web, and concentrates material at the bulb extremity.
Figure 5:
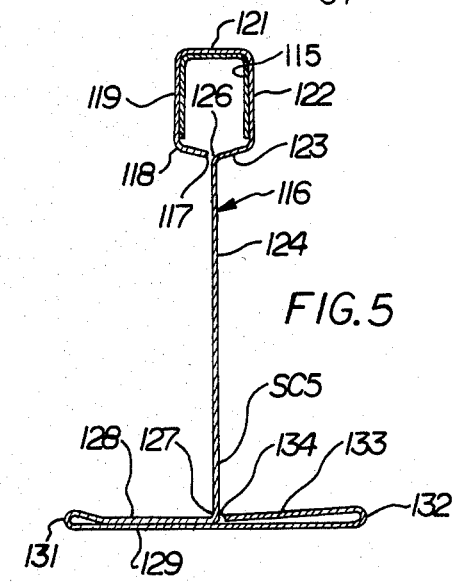
FIG. 5 is an embodiment of a single layer web grid in which two strips of metal are used to form the bulb and in which the shear center is substantially along the central plane of the grid.
Figure 4:
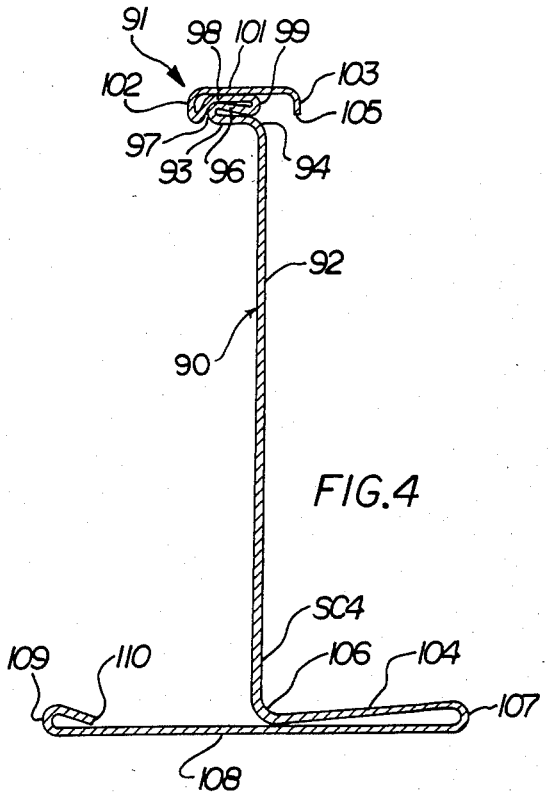
FIG. 4 is still another embodiment formed of a single strip of metal, is nonsymmetrical, and provides a centrally located shear center.

FIGS. 3 through 5 illustrate embodiments of this invention which provide a single layer web. Such embodiments, therefore, reduce the amount of web material which does not contribute materially to the strength of the grid. Referring to FIG. 3, the grid of such embodiment is formed of a single strip of metal 61 shaped to provide a single layer central web 62, a closed bulb 63 at the upper edge of the web 62, and opposed, symmetrical flanges 64 and 66 at the lower extremity of the web. The strip of metal 61 is formed to extend from a first edge 67 along an inclined portion 68 to a bend 69 at one lateral extremity of the bulb 63. From the bend 69, the strip extends in a direction laterally spaced from but parallel to the web 62 along a portion 71. At the upper extremity of the wall portion 71, the metal is again bent to provide three laterally extending layers 72, 73, and 74 adajcent to the upper extremity of the web. These layers are formed in the same manner as in the embodiment of FIGS. 1 and 2, and are therefore not described in detail herein. The bulb 63 provides an oppositely extending wall portion 76 substantially parallel to and spaced from the wall portion 72, which extends to a bend at 77 to provide an inclined wall portion 78. At the bend 79, the wall portion 78 is integrally joined with the upper edge of the web 62.

At the lower edge of the web 62, the material 61 is bent with a right angle bend at 81, and extends therefrom along a lateral portion 82 to a reverse bend at 83 at the extremity of the flange 66. From the reverse bend at 83, the strip extends back along the underside of the grid past the central web 62 to provide the lateral flange 64. From a reverse bend at 84, the strip extends back to an edge 86 adjacent to the web 62. It should be noted that, here again, a substantial amount of material is concentrated adjacent to the upper extremity of the bulb and at the flange extremity for efficient material usage in which substantial rigidity is provided with a minimum material requirement. In this embodiment, however, the grid is again symmetrical with respect to the central web 62, so the shear center is located at about SC3 along the plane of the web. The flange 64 is not directly connected to the central web, but is only connected to the central web through the flange 66. Similarly, the bulb 63, although basically symmetrical in shape, is not connected to the web at 67.

With the present invention, which the open sides of the bulb and the flange are on opposite sides of the web, and the shear center of the section is along the center of the grid, less material is required to produce a grid of a given resistance to roll failure. Further, with the embodiment of FIG. 3, three layers are provided at the bulb extremity by reverse bends, and the flange 66 is formed with double layers to concentrate material at the flange extremity of the grid for rigidity.

FIG. 4 illustrates an embodiment in which a bulb 91 provided at the upper extremity of the central web 92 is not formed as a closed, generally symmetrical structure. In the grid of FIG. 4, a single strip of metal 90 is again shaped to produce the entire grid. The bulb 91, however, is formed by a lowermost layer 93 joined to the web at a bend 94, a second or intermediate layer 96 joined to the layer 93 by a reverse bend at 97, a third layer 98 joined to the layer 96 by a reverse bend at 99, and a fourth layer 101 joined to the layer 98 by a reverse bend at 102. As illustrated, the reverse bend at 92 may be formed to provide an edge extending downwardly past the reverse bend 97 and the opposite edge of the layer 101 may be formed with a depending portion 103.

The lower end 105 of the depending portion is preferably located in lateral alignment with the lower edge of the bend 102, so that the bulb envelope is symmetrical. This facilitates the hanging of the grid on a wire in the usual manner.

The flanges of the grid are provided by a lateral portion 104 extending from a right angle bend at 106 to a reverse bend at 107. From the reverse bend, the strip extends along a lower flange face portion 108 past the web 92 to a reverse bend at 109 adjacent to the edge of the strip at 110.

In this embodiment, there are four layers extending laterally adjacent to the upper extremity of the grid to provide substantial material at such extremity and efficient use of such material in establishing the rigidity of the device.

The grid is not symmetrical. The shear center in this grid tee is located at about SC4 substantially along the web. In order to provide a shear center close to or along the central web, the bulb is formed so that the layers 93, 96, and 98 are all located on the left side of the plane of the central web 92, as illustrated in FIG. 4, and the double layer side of the flange is located on the right side, as viewed in such figure. In this illustrated embodiment, only the upper layer 101 extends to both sides of the central web so as to facilitate proper hanging of the grid, while still providing more bulb material on the side of the web opposite the double-layered side of the flange.

It should be understood that, if desired, the material could be formed to provide even more layers and to locate the layers on appropriate sides of the central web to achieve the desired location of the shear center to resist roll failure of the grid. It should be recognized also that because substantial amounts of material are located or concentrated at the extremities of the grid, a relatively rigid grid section is provided with a minimum amount of material.

In the embodiment of FIG. 5, multiple layers are provided at the bulb extremity by separate pieces or strips of metal. However, a central location of the shear center and a double layer flange are achieved in the overall grid with only one additional strip of material 115. In this embodiment, a main strip of material 116 is formed from one edge 117 to provide a lateral portion 118, a wall portion 119, an upper bulb portion 121, a second wall portion 122 spaced from and substantially parallel to the wall portion 119, and an inwardly extending lateral wall portion 123 which is integrally joined with a central web 124 at a bend 126. The flanges are provided by bending the strip 116 from a right angle bend at 127 to provide an upper flange layer 128 joined to a lower flange layer 129 at a reverse bend at 131. The lower layer 129 extends past the central web to a reverse bend at 132 and an upper flange portion 133 extends inwardly to a location at the edge 134 substantially adjacent to the central web 124. The flanges of this embodiment are joined to the web only on the left side as viewed in FIG. 5, and the bulb material is joined to the central web only on the right side as viewed therein. The grid section is relatively well-balanced in that the shear center is located substantially along the central web 124 at about SC5 and the grid is capable of withstanding substantial loads for the amount of material forming the grid without roll failure. Further, substantial amounts of material are provided at the two extremities of the grid to provide rigidity and a very efficient use of material is achieved.

Although preferred embodiments of this invention have been shown and described, it should be understood that various modifications and rearrangements of the parts may be resorted to without departing from the scope of the invention as disclosed and claimed herein.

What is claimed is:

1. A grid tee for suspension ceilings comprising a thin strip of metal bent to form a generally planar central web, a bulb along one extremity of said web and oppositely extending panel supporting flanges along the opposite extremity of said web, said bulb having a lateral width substantially less than the total lateral width of said flanges, said strip of metal providing at least two reverse bends at the extremity of said bulb remote from said web, said reverse bends interconnecting at least three layers of said metal extending laterally with respect to said bulb at the extremity thereof remote from said web, said layers being in substantial face-to-face contact, said layers operating to concentrate metal at the bulb extremity of said tee to improve the strength and stiffness thereof to resist loads encountered when panels are supported on said flange, said metal providing substantially right angle bends at the ends of said layers so that said bulb provides spaced metal portions substatially parallel to said web on opposite sides thereof extending from said layers in the direction of said web, said substantially parallel metal portions on opposite sides of said web extending to inturned bends to provide inwardly extending metal portions extending to said web at the bulb extremity thereof thereby providing a hollow substantially closed bulb with multiple layers along the extremity thereof remote from said web, at least one of said inwardly extending metal portions being joined to said web, said metal being bent to provide four reverse bends with two reverse bends being opposite and substantially abutting, two of said layers being provided by separate substantially coplanar laterally extending metal portions.

2. A grid tee as set forth in claim 1, wherein said opposite reverse bends abut along the plane of said web.

3. A grid tee as set forth in claim 1, wherein the shear center of said grid is substantially along the plane of said web.

* * * * *